US006142848A

United States Patent [19]

Madner et al.

[11] Patent Number: 6,142,848

[45] Date of Patent: Nov. 7, 2000

[54] EDUCATIONAL TOY COMPONENTS

[75] Inventors: Peter Madner; John Rex Langford, both of Sunshine, Australia

[73] Assignee: Geo Australia Pty. Limited, Sunshine, Australia

[21] Appl. No.: 09/072,528

[22] Filed: May 4, 1998

Related U.S. Application Data

[63] Continuation of application No. 08/232,061, Jun. 28, 1994, abandoned.

[30] Foreign Application Priority Data

Aug. 28, 1992 [AU] Australia ..... 4352/92

[51] Int. Cl.[7] ..... A63H 33/08

[52] U.S. Cl. ..... 446/115; 446/116; 446/107; 446/125

[58] Field of Search ..... 446/102, 104, 446/107, 108, 112, 115, 116, 125

[56] References Cited

U.S. PATENT DOCUMENTS

| | | | |
|---|---|---|---|
| 4,055,019 | 10/1977 | Harvey | 446/116 X |
| 4,309,852 | 1/1982 | Stolpin | 446/116 X |
| 4,874,341 | 10/1989 | Ziegler | 446/125 X |
| 5,100,358 | 3/1992 | Volgger | 446/116 X |
| 5,501,626 | 3/1996 | Harvey | 446/125 X |

FOREIGN PATENT DOCUMENTS

| | | | |
|---|---|---|---|
| 546535 | 9/1957 | Canada | 446/116 |
| 0109181 | 5/1984 | European Pat. Off. | 446/104 |

*Primary Examiner*—D Neal Muir
*Attorney, Agent, or Firm*—Edwin D. Schindler

[57] ABSTRACT

A constructional toy component (13) which has on at least one edge (11), two portions (15, 16) each of which has associated therewith one of two complementary members (19, 18) the arrangement being such that when two similar edges are brought into abutment but in the opposite sense, the complementary members (19, 18) can interengage if one of the components is initially flexed to effectively vary the spacing between the complementary members thereon. In one form of the invention, the edges are formed of rod like members and thus the component is basically defined by a peripheral frame.

6 Claims, 3 Drawing Sheets

EDUCATIONAL TOY COMPONENTS

This is a continuation of application Ser. No. 08/232,061, filed Jun. 28, 1994, now abandoned.

BACKGROUND OF THE INVENTION

1. Technical Field of the Invention

This invention relates to an educational toy and, in particular to constructional toys which can be interconnected.

2. Description of the Prior Art

There have been many different forms of educational toys which are known generally as constructional toys in which the various components connect together.

Some of these, and the ones to which this invention relate are basically in the form of flat members which may have various shapes, such as triangles, squares, pentagons etc. and which are connected together by complimentary portions along adjacent edges.

One well known toy of this type is sold under the registered trade mark "Polydron". The Polydron toy has along its length one portion which extends outwardly to a notional periphery of the side and a portion which is located inwardly of this, the outwardly directed portion having a cut away portion adjacent its outer edge and the inward portion having an outwardly extending portion on its outer edge, the inward edge portion being effectively in line with the inward portion of the edge and the outward end portion being effectively in line with the outward portion.

In the Polydron toy at the junction of the two portions there is a spring member which is formed of the same material as the body of the toy and defined by two cut outs directed towards the centre of the toy.

The portions are formed with a pip on the outer edge of the outwardly directed portion and a dimple on the outwardly directed end portion adjacent the inward portion so that when two like members are engaged but are inverted one relative to the other, the pips and dimples engage and there is a resilient outward pressure provided by the spring members which are in contact with each other.

It will be seen that the two members so inter-engaged are effectively pivotally connected to each other and by proper relationship with other members, structural members can be produced.

The Polydron toy, whilst satisfactory has a number of disadvantages.

First of these is that the spring members are put under stress when adjacent members are interconnected and they can well break and, once, one of these members is broken, there is no pressure put on the junction between the pips and dimples and the components do not hold together.

The second is that where the members are solid it can be difficult to construct a complex shape as the building of the shape has to all be done from effectively the outer surface. A further disadvantage is that the members are relatively expensive in that they are formed from solid plastics material and the quantity of plastics in each component is relatively high.

SUMMARY OF THE INVENTION

It is an object of the present invention to provide a constructional toy which minimises the above disadvantages.

The invention, in its broadest sense, includes a constructional toy component adapted to be connected to at least one other component having a similar formation, the toy component having at least one edge which has two portions with one being further away from the interior of the component relative to, the other, the portions being connected at their adjacent ends, the outer portion having at its other end a first complementary member, the other portion having adjacent its other end a second complementary member, the arrangement being such that when two components are brought together and one of the components is flexed so that the spacing between the complementary members thereof is reduced, the first complementary member of one component can be brought into contact with the second complementary member of the other component, and the other complementary members can also be brought into engagement but, after engagement is completed, and the flexing is released, there is effectively no deformation of either component, but the components are held together by the inter-relationship of the complementary members.

It is preferred that each portion is a rod-like member.

It is also preferred that toy component is made of a number portions each of which is a rod-like members and is open.

The portions effectively have parallel axes the arrangement being such that when the adjacent components are engaged, the portions of the adjacent components closely abut.

BRIEF DESCRIPTION OF THE FIGURES

In order that the invention be more readily understood and put into practice, we shall describe one embodiment of this in relation to the accompanying drawings, in which.

DETAILED DESCRIPTION OF THE DRAWING FIGURES AND PREFERRED EMBODIMENTS

Figure 1:
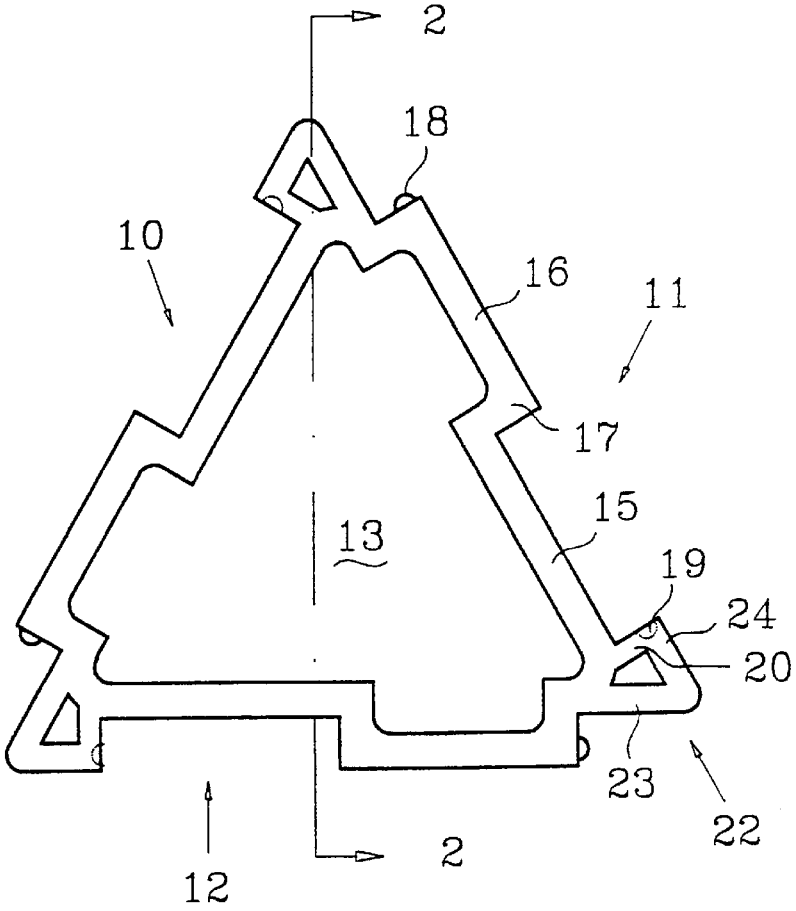
FIG. 1. shows a plan view of a triangular component made in accordance with the invention.
Figure 2:
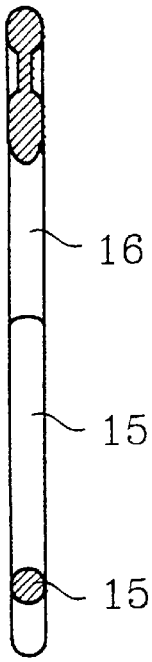
FIG. 2. is a section along line 2—2 of FIG. 1.

The simplest form of construction component made in accordance with the invention is a triangle, as illustrated in FIGS. 1 and 2 and, in accordance with the first embodiment, it is an open triangle having three sides 10, 11, 12 each of which is similar to that described hereinbefore with the central portion of the triangle open.

Each side has a pair of rod like portions 15, 16 which are interconnected 17 at their inner ends.

The rod like portion 16 has an extension 18 which is coaxial with the portion and the rod like portion 15 has a recess 19 which is also coaxial with the rod like portion 16 and which is on an extension 20 which is directly outwardly from the portion 15.

The extension 18 and the recess 19 may both be in the forms of generally hemispherical members.

The general shape of the portion 22 which, amongst other includes the recess 19 is adapted to assist in providing the triangular shape and one side of which 23 acts to receive the side 24 of an adjacent side, where members are connected.

As mentioned above, each of the sides 10, 11 and 12, can be considered to be identical.

Figure 3:
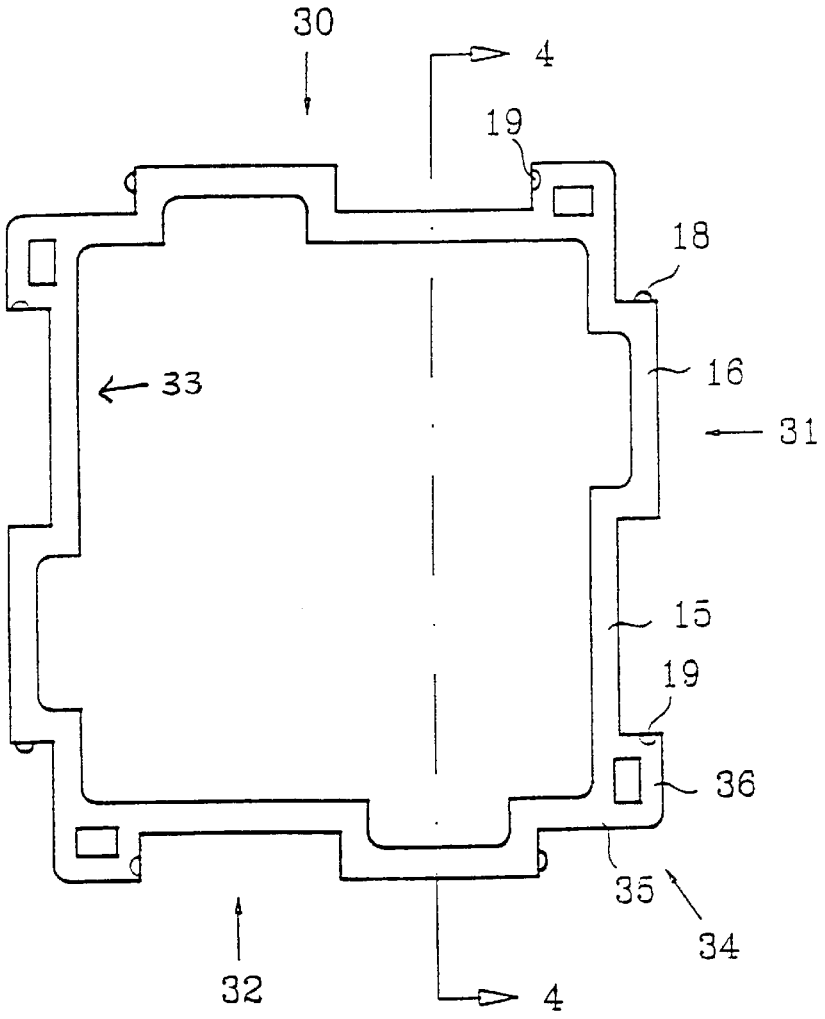
FIG. 3. is a plan view of a square component of the invention.
Figure 4:
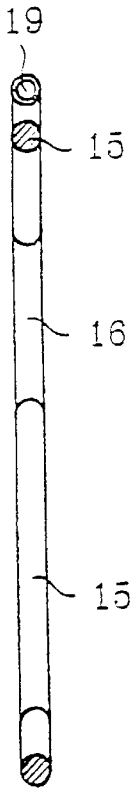
FIG. 4. is a section along line 4–4 of FIG. 3.

The square components shown in FIGS. 3 and 4, have four sides, each of which can be considered to be identical to the side 11 except that in this case, the portion 34 is basically itself rectangular rather than triangular but portion 35 can be considered to be identical to portion 23 of the earlier embodiment and the portion 36 is effectively equivalent to the portion 24 in that they cooperate in the same way.

Whilst we have fully illustrated the triangle and the square, the component can, as has been the case with previous systems, be of a number of different shapes, including pentagon, hexagon or even rhomboid and, if required, they could have internal components.

Figure 5:
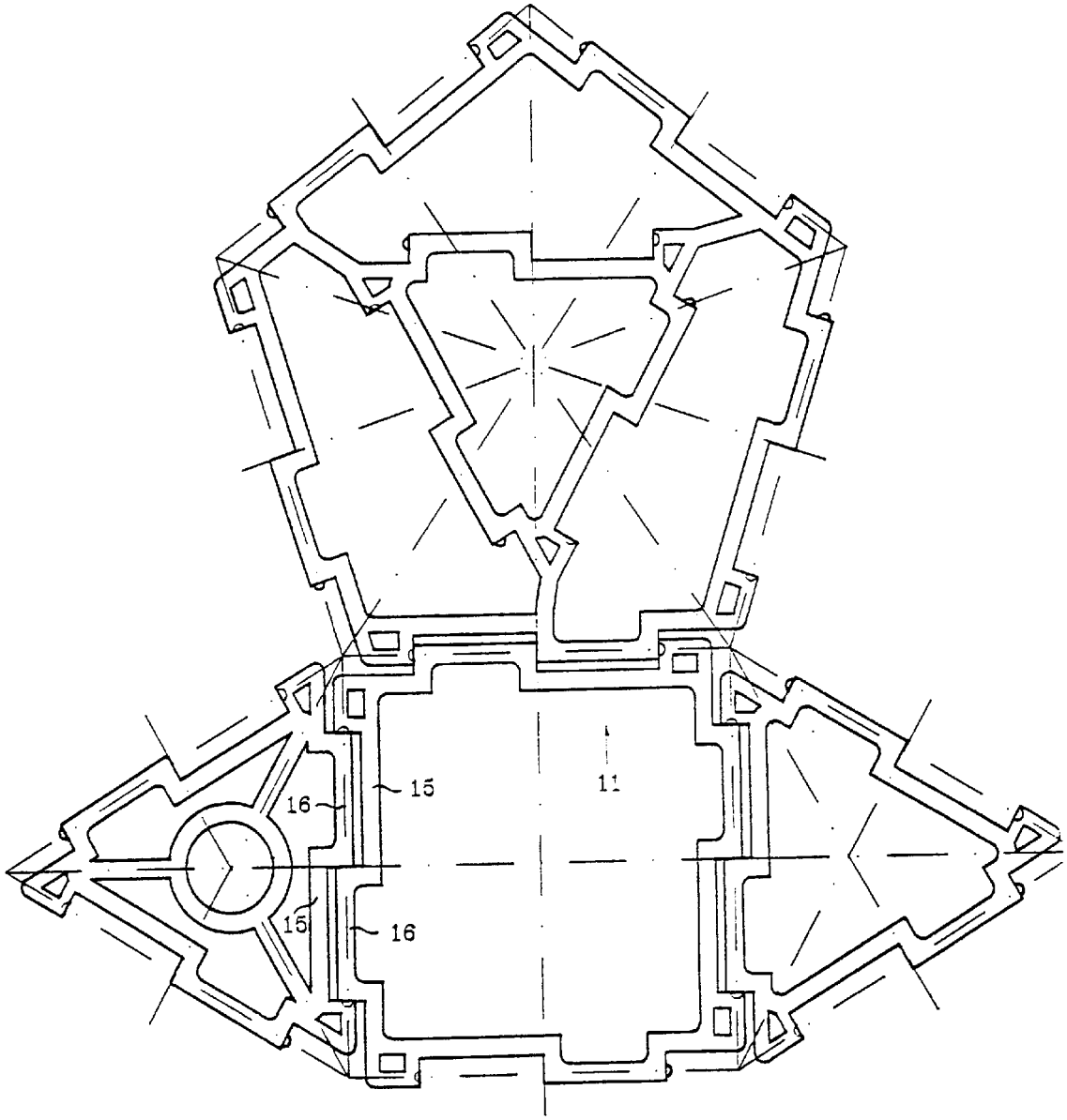
FIG. 5. is a view showing several of the components of the invention connected together.

FIG. 5 shows the interconnection of four different shapes, the triangle and square already illustrated, a triangle having an internal configuration which will be described more fully later, and a pentagon.

FIG. 5 shows these components lying in a single plane.

In order for each component to be interconnected, the component to be connected thereto is rotated so that the side is complimentary to the side of the first component and that is so that the extension 18 are in each case adjacent the recesses 19.

The length of the portions 15 and 16 permit this as do the spacings of the axis of these portions one from the other.

In order that the components be interconnected, there needs to be a certain capability of flexing of the component and this can occur in several ways.

Basically, these necessitate relative movement between the extensions 18 and the recesses 19.

As the sides themselves are relatively small diameter rods, compared to the size of the overall component, sufficient movement can be effected simply by a flexing of one of the sides so that the distance between the extension and the recess of this rod is reduced, permitting them to come into inter-engagement with the complimentary part of the adjacent component. When we state that the flexing is of one side, it will be appreciated that there tends to be flexing over the component generally.

Depending on how the components are being interconnected, it will be seen that the flexure can be in any direction, in the plane or away from the plane of the component.

A major feature of the present invention is that when the adjacent sides are so engaged, there is effectively no stress on either of the components. This means that the flexing occurs only during the period of engagement when the components are being inter-connected. Once engagement has occurred, the arrangement is without further stress. Thus, there can be no long term change in the components as a result of their interconnection.

As can be appreciated from the examination of FIG. 5, it is possible to rotate the adjacent members one relative to the other and, as adjacent sides come into alignment on such movement, they, to, can be inter-engaged.

Again, the arrangement of the various shapes of members are such that they can inter-engage into each other with no difficulty and, again, once inter-engagement has occurred, there is no stress on the members. In this way, a substantial three dimensional construction can be made.

It is also possible to make constructions where the members do not lie in their natural plane. In these circumstances, there will be stress over the whole of the component which is moved away from its normal plane but this stress does not have to do with stress because of the inter-connection.

It will be seen that the component of the present invention has the advantages previously set out as being required and that is that it can readily be fitted together and, in particular, if there is a complex shape to be made it is possible to work both from the inside and outside of individual components, which has not generally previously been possible, although some components have been proposed with central apertures. These have been generally relatively small compared to the overall component whereas the rods that constitute the sides of the components of the present invention are small relative to the overall size.

Also, because of the relatively small amount of plastics used, it is possible to use engineering grade plastics without unduly adversely affecting the costs of manufacture of the components so that a higher quality product can be obtained at a price which is substantially less than would be possible if the same material was used to make solid components. The use of such material provided a product which is particularly robust in use.

The component of the invention can also have certain enhancements if these be required.

The first, to enable interconnection of different components or constructions we may provide a circular member located within the body of the members and connected thereto, possibly, by radial arms connecting into corners. One such arrangement is shown in the left triangle of FIG. 5.

The actual mode of connection of the circular member can vary depending upon the shape of the particular component.

This component may act as a connector to a rod having a deformable mouth extending from each end thereof, which mouths are adapted to pass over and be retained by the circular member.

It will be appreciated that the diameter of the periphery of the circular member must be such as to engage with the mouth of the rod.

The rods can be formed with a mouth in the form of two spaced members and rods themselves may be interconnected to obtain an extension by engagement end to end.

In another aspect of the invention we may provide panels which act as covers to the various members. In one particular form, such panels may have integral clips which are adapted to fit over the members of the shape to be covered, the clips being complementary with the shape of the rods and, one again, the clips may be deformed whilst being fitted but be in a non-stressed condition once fitted.

Alternatively, we could provide pins extending outwardly from each corner which are adapted to enter engage with holes in panel members or vice versa.

By the use of such panel members we may effectively cover the whole of the adjacent constructional member.

This arrangement is such that a space frame can be built from the constructional members and then, if required, the space frame can be sheathed to provide the final end product.

From a teaching point of view, such an arrangement gives teachers advantages in that they can demonstrate various three dimensional concepts but on appreciation of the concepts then the product can be sheathed to provide a solid body.

Whilst not specifically illustrated, it is possible to make the components of the invention in the form of solid components.

Whilst this may limit some of the advantages previously referred to, it is still possible to connect the members together with only a short term flexure of the body of the component itself and, after connection, leave the interconnected components unstressed.

The claims defining the invention are as follows:

1. A constructional toy component being in an open frame, comprising:

at least, three sides, each of said sides being formed of rod-like members and defining a border forming an interior having a central point thereof, at least two of said rod-like members having parallel spaced axes and being interconnected at their adjacent ends, with one of said rod-like members displaced outward from the central point further than the adjacent rod-like member, said rod-like members being capable of cooperating with a similar pair of rod-like members of another, similarly constructed constructional toy component;

an extension being located substantially axially on a non-contiguous end of one of said rod-like members, the non-contiguous ends located furthest from the central point of the interior of the open frame of said constructional toy component; and, a recess complementary to said extension located adjacent the non-contiguous end of said one of said rod-like members and being substantially co-axial with an axis of said rod-like members displaced further from the central point of the interior of the open frame of said constructional toy component, each of said sides being resiliently deformable between two ends of said side, so that when two of said sides of different constructional toy components are brought together, at least one of said sides is flexed, thereby enabling an inter-engagement, whereby said extension of one of said rod-like members enters the recess of another said constructional toy components, and vice versa, so that when flexure is released, there is no deformation of said sides of said constructional toy components and said constructional toy components are held together by an inter-relationship of complementary rod-like members extension.

2. The constructional toy component according to claim 1, wherein said extension is a substantially hemispherical extension and said recess is a complementary, substantially hemispherical recess.

3. The constructional toy component according to claim 1, wherein said constructional toy component is an injected plastic molding.

4. An educational toy, comprising:

a plurality of constructional toy components each being in an open form and including:

at least, three sides, each of said sides being formed of rod-like members and defining a border forming an interior having a central point thereof, at least two of said rod-like members having parallel spaced axes and being interconnected at their adjacent ends, with one of said rod-like members displaced outward from the central point further than the adjacent rod-like member, said rod-like members being capable of cooperating with a similar pair of rod-like members of another, similarly constructed constructional toy component;

an extension being located substantially axially on a non-contiguous end of one of said rod-like members, the non-contiguous ends located furthest from the central point of the interior of the open frame of said constructional toy component; and, a recess complementary to said extension located adjacent the non-contiguous end of said one of said rod-like members and being substantially co-axial with an axis of said rod-like members displaced further from the central point of the interior of the open frame of said constructional toy component, each of said sides being resiliently deformable between two ends of said side, so that when two of said sides of different constructional toy components are brought together, at least one of said sides is flexible, thereby enabling an inter-engagement, whereby said extension of one of said rod-like members enters the recess of another said constructional toy components, and vice versa, so that when flexure is released, there is no deformation of said sides of said constructional toy components and said constructional toy components are held together by an inter-relationship of complementary rod-like members extensions and recesses.

5. The educational toy according to claim 4, wherein each said extension of said plurality of constructional toy components is a substantially hemispherical extension and each of said recesses is a complementary, substantially hemispherical recess.

6. The educational toy according to claim 4, wherein each of said plurality of constructional toy components is an injected plastic molding.

* * * * *